US007884770B2

(12) United States Patent
Yanagi et al.

(10) Patent No.: US 7,884,770 B2
(45) Date of Patent: Feb. 8, 2011

(54) COMMUNICATION APPARATUS

(75) Inventors: Masahiro Yanagi, Shinagawa (JP); Shigemi Kurashima, Shinagawa (JP); Hideki Iwata, Shinagawa (JP); Takashi Yuba, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 84 days.

(21) Appl. No.: 12/127,911

(22) Filed: May 28, 2008

(65) Prior Publication Data

US 2008/0231523 A1 Sep. 25, 2008

Related U.S. Application Data

(62) Division of application No. 11/542,162, filed on Oct. 4, 2006, now Pat. No. 7,394,431.

(30) Foreign Application Priority Data

Jan. 18, 2006 (JP) ..... 2006-010236

(51) Int. Cl.
*H01Q 1/24* (2006.01)

(52) U.S. Cl. ..... 343/702

(58) Field of Classification Search ..... 343/702, 343/700 MS, 872
See application file for complete search history.

(56) References Cited

U.S. PATENT DOCUMENTS

| | | | | |
|---|---|---|---|---|
| 5,905,467 | A * | 5/1999 | Narayanaswamy et al. | 343/702 |
| 5,918,163 | A * | 6/1999 | Rossi | 455/558 |
| 5,943,018 | A * | 8/1999 | Miller | 343/702 |
| 6,259,409 | B1 * | 7/2001 | Fulton et al. | 343/702 |
| 6,356,773 | B1 | 3/2002 | Rinot | |
| 6,573,868 | B2 * | 6/2003 | Johnson et al. | 343/702 |
| 6,618,013 | B1 * | 9/2003 | Aldous | 343/702 |
| 6,788,270 | B2 * | 9/2004 | Suprunov et al. | 343/866 |
| 7,180,472 | B2 | 2/2007 | Yegin et al. | |
| 7,190,311 | B2 * | 3/2007 | Dawson et al. | 343/702 |
| 7,262,737 | B2 * | 8/2007 | Zarnowitz et al. | 343/702 |
| 2006/0197707 | A1 | 9/2006 | Tsai et al. | |

OTHER PUBLICATIONS

U.S. Appl. No. 11/542,162, filed Oct. 4, 2006, Masahiro Yanagi, et al., Fujitsu Component Limited.
Office Action mailed from the USPTO on Nov. 7, 2007 in the related U.S. Appl. No. 11/542,162.
Notice of Allowance mailed from the USPTO on Mar. 26, 2008 in the related U.S. Appl. No. 11/542,162.

* cited by examiner

*Primary Examiner*—Hoang V Nguyen
(74) *Attorney, Agent, or Firm*—Staas & Halsey LLP

(57) ABSTRACT

A communication apparatus is provided that includes an apparatus main frame, an antenna, and a connecting element that connects the antenna to the apparatus main frame and positions the antenna away from the apparatus main frame.

2 Claims, 23 Drawing Sheets

COMMUNICATION APPARATUS

CROSS-REFERENCE TO RELATED APPLICATIONS

This application is a Divisional application of application Ser. No. 11/542,162 filed Oct. 4, 2006 now U.S. Pat. No. 7,394,431, now allowed, and is based upon and claims the benefit of priority from the prior Japanese Patent Application No. 2006-010236, filed on Jan. 18, 2006, the entire contents of which are incorporated herein by reference.

BACKGROUND OF THE INVENTION

1. Field of the Invention

The present invention relates to a communication apparatus that establishes communication using an antenna.

2. Description of the Related Art

Presently, there is a high demand for wireless technology owing to the development of miniaturized and cable-less products, for example. Also, there is a high demand for high speed transmission technology owing to the increase in data capacity of communication apparatuses. In this respect, the UWB (ultra wide band) communication scheme is being highly regarded as having much potential for close-range large-capacity data communication.

It is noted that an antenna used in UWB communication has a relatively large area compared to a conventional narrowband antenna since the UWB antenna has to resonate at a wider range of frequencies. Thus, the UWB antenna generally takes up greater space. Also, the UWB antenna generally has to be positioned as far away from the main apparatus circuit as possible in order to avoid receiving influences from the main apparatus circuit.

SUMMARY OF THE INVENTION

According to an aspect of the present invention, a communication apparatus is provided that is capable of reducing the influence of a main apparatus circuit on an antenna.

According to an embodiment of the present invention, a communication apparatus is provided that includes an apparatus main frame, an antenna, and a connecting element that connects the apparatus main frame to the antenna and positions the antenna away from the apparatus main frame.

BRIEF DESCRIPTION OF THE DRAWINGS

FIGS. 19A and 198 are diagrams illustrating an apparatus main frame of the communication apparatus according to the second embodiment;

DETAILED DESCRIPTION OF THE PREFERRED EMBODIMENTS

In the following, preferred embodiments of the present invention are described with reference to the accompanying drawings.

Figure 1:
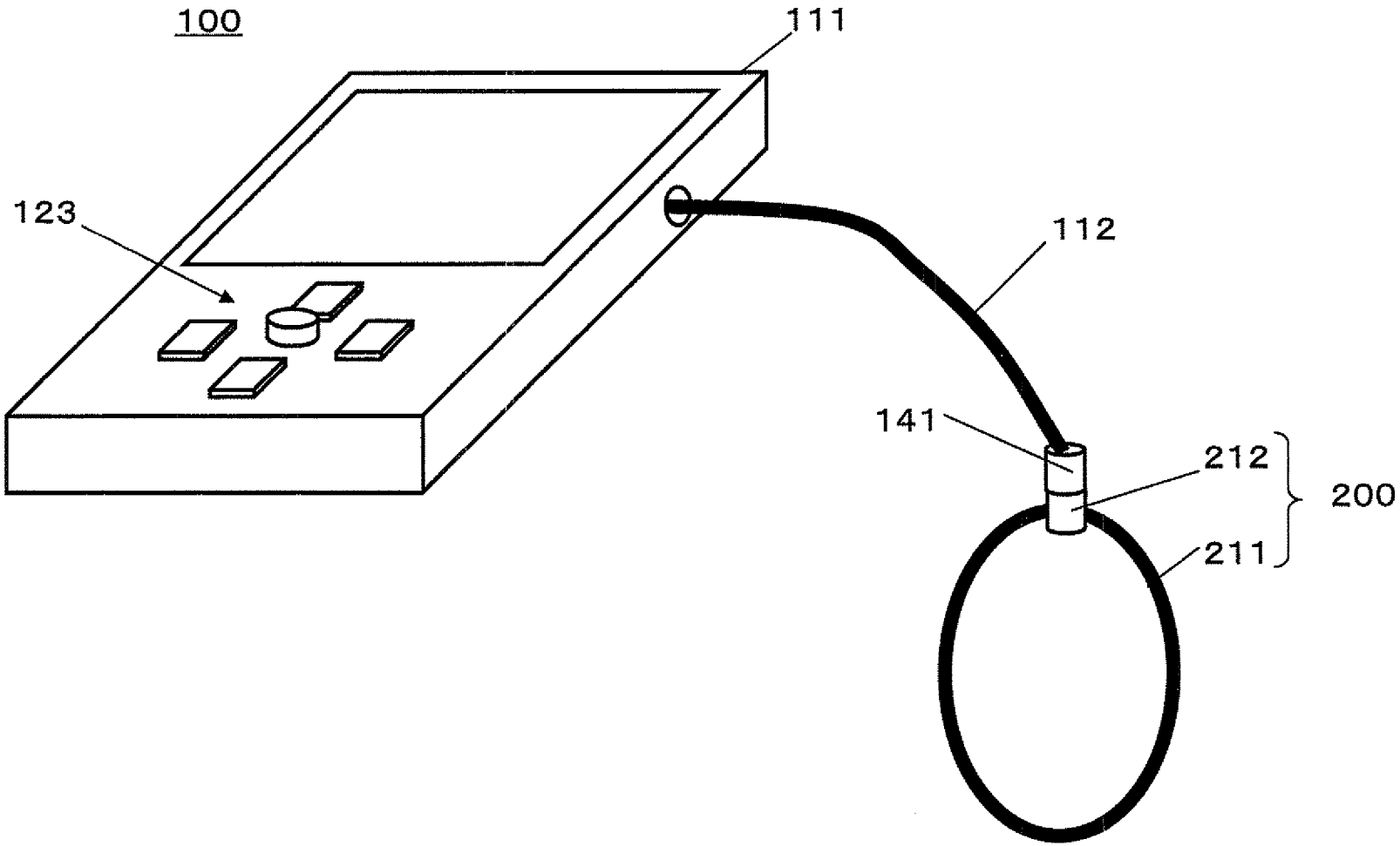
FIG. 1 is a perspective view of a communication apparatus according to a first embodiment of the present invention.

FIG. 1 is a perspective view of a communication apparatus according to a first embodiment of the present invention.

The illustrated portable communication apparatus 100 according to the present embodiment may be a data communication apparatus such as a PDA, a mobile phone, a portable personal computer; or a data receiving apparatus such as a portable TV or a portable radio that receives television broadcast or radio broadcast, for example. The portable communication apparatus 100 includes an apparatus main frame 111, an antenna apparatus 200 for establishing data communication and receiving television broadcast or radio broadcast, and a connecting element 112 that extends from the side of the apparatus main frame 111 and connects the antenna apparatus 200 to the apparatus main frame 111.

Figure 2:
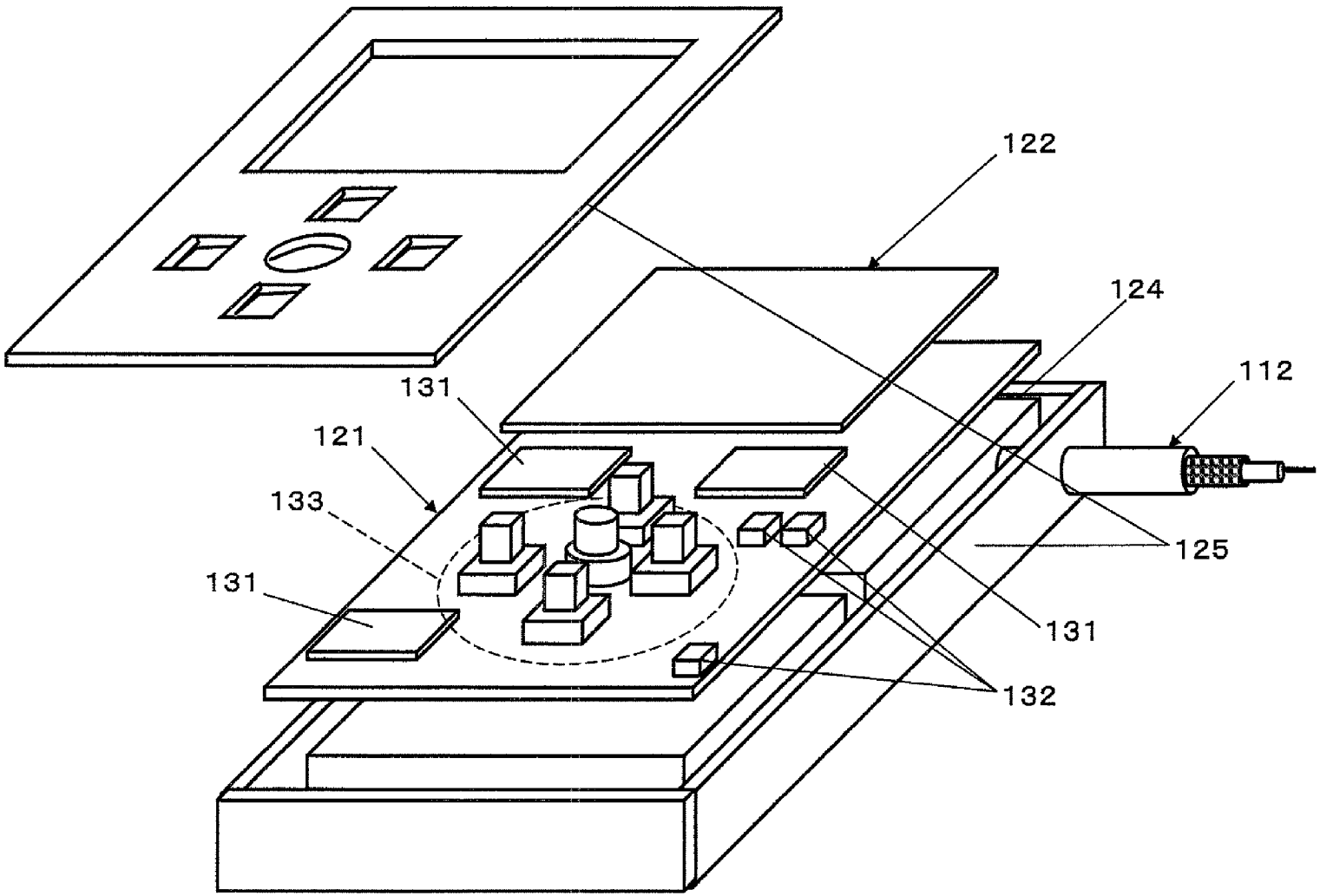
FIG. 2 is an exploded perspective view of an apparatus main frame of the communication apparatus according to the first embodiment.

FIG. 2 is an exploded perspective view of the apparatus main frame 111.

The apparatus main frame 111 includes a circuit substrate 121, a display unit 122, a communications unit 123, and a battery package 124 that are accommodated within a case 125.

The circuit substrate 121 has an IC chip 131 such as a CPU, electronic components 132, and a key switch unit 133 comprising an operations unit mounted thereon. Also, the circuit substrate 121 is connected to the display unit 122, the communications unit 123, and the battery package 124, and is driven by a power voltage supplied thereto from the battery package 124 to perform various information processes. The display unit 122 displays images processed at the circuit substrate 121, for example. The communications unit 123 has a high frequency circuit built therein, and is configured to transmit processed data from the circuit substrate 121 to the outside via the antenna apparatus 200, decode signal waves received at the antenna apparatus 200, and supply the decoded signals to the circuit substrate 121, for example.

The connecting element 112 may be a coaxial cable that has one end fixed to a circuit substrate within the communications unit 124 through soldering, for example. In the illustrated example of FIG. 1, the other end of the connecting element 112 is integrally attached to a connector 141. The connector 141 may be a plug or socket connector such as an SMA connector, a BNC connector, or an earphone jack that is detachably connected to the antenna apparatus 200, for example.

The antenna apparatus 200 includes an antenna device 211 and a connector 212. The antenna device 211 may be a wire antenna, a rod antenna, a loop antenna, or a helical antenna, for example, and includes a supply line that is connected to the connector 212. The connector 212 may be a plug or socket connector such as an SMA connector, a BNC connector or an earphone jack that is detachably connected to the connector 141. The antenna apparatus 200 is detachably connected to the connecting element 112 by means of the connector 212.

According to the present embodiment, the antenna apparatus 200 may be connected to the apparatus main frame 111 via the connecting element 112 comprising a coaxial cable, for example, so that the antenna 200 may be positioned away from the apparatus main frame 111. In this way, the antenna apparatus 200 may be protected from noise generated at the apparatus main frame 111 upon establishing wireless communication.

In one preferred embodiment, adequate connection power is secured for connecting the connector 141 and the connector 212 so that the antenna apparatus 200 may not be easily detached from the apparatus main frame 111. In a further embodiment, the antenna apparatus 200 may be used as a strap for carrying the portable communication apparatus.

In this case, antenna matching conditions for the antenna apparatus 200 are set taking the usage environment into consideration.

Figure 3A:
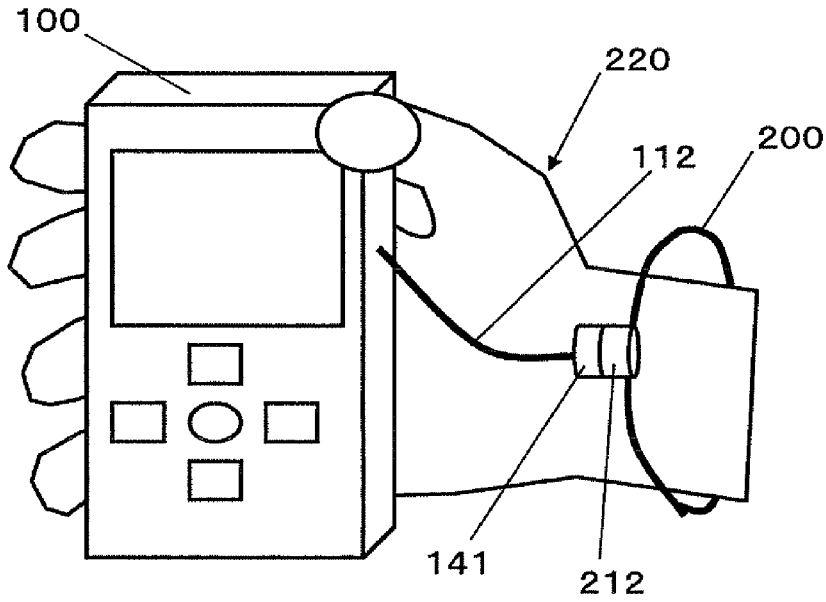
FIGS. 3A and 3B are diagrams illustrating matching of the antenna apparatus of the communication apparatus according to the first embodiment.
Figure 3B:
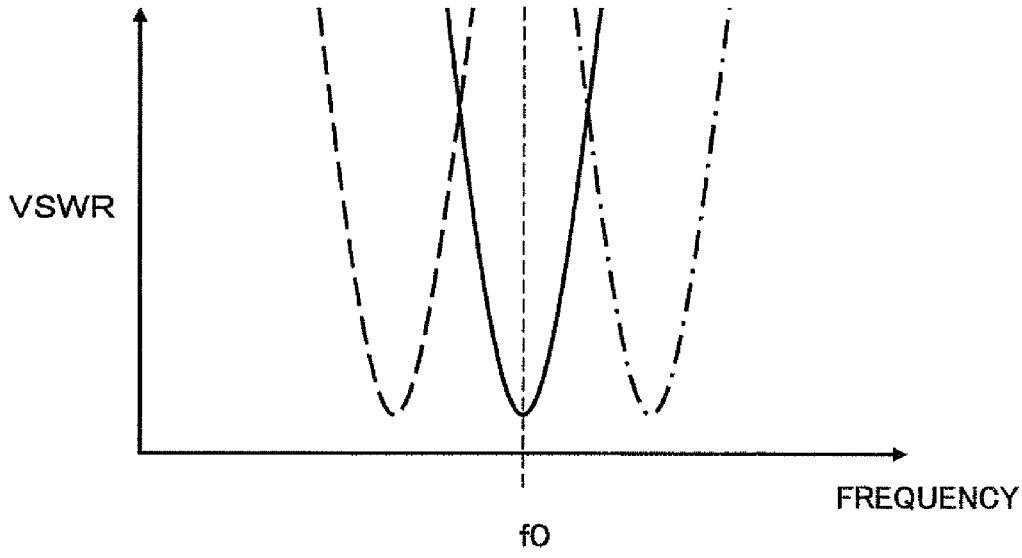

FIGS. 3A and 3B are diagrams illustrating matching of the antenna apparatus 200.

In a case where the antenna apparatus 200 is used as a strap for carrying the portable communication apparatus 100 as is illustrated in FIG. 3A, if the antenna apparatus 200 is matched with a desired frequency represented by the solid line in FIG. 3B, the antenna apparatus 200 may receive influences from the hand 220 (see FIG. 3A) and deviate from the desired frequency as is illustrate by the broken line in FIG. 3B. Accordingly, antenna matching conditions for the antenna apparatus 200 may be set taking into consideration the influences from the hand 220. In a specific example, the antenna apparatus 200 may be matched with a frequency represented by the dot-dashed line shown in FIG. 3B so that the antenna may be matched with the desired frequency represented by the solid line in FIG. 3B.

[First Modification]

Figure 4:
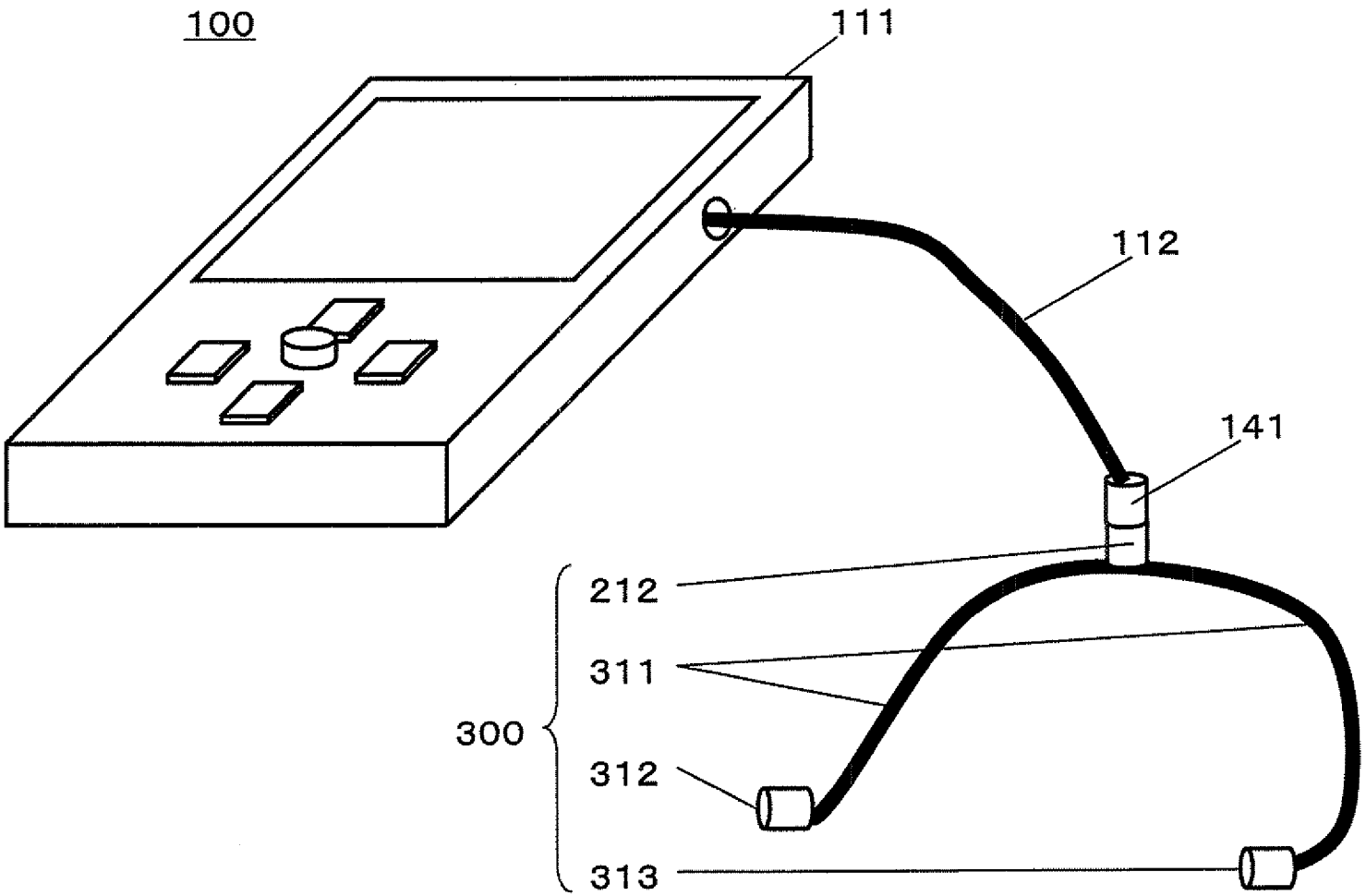
FIG. 4 is a perspective view of a communication apparatus according to a first modification of the first embodiment.
Figure 5:
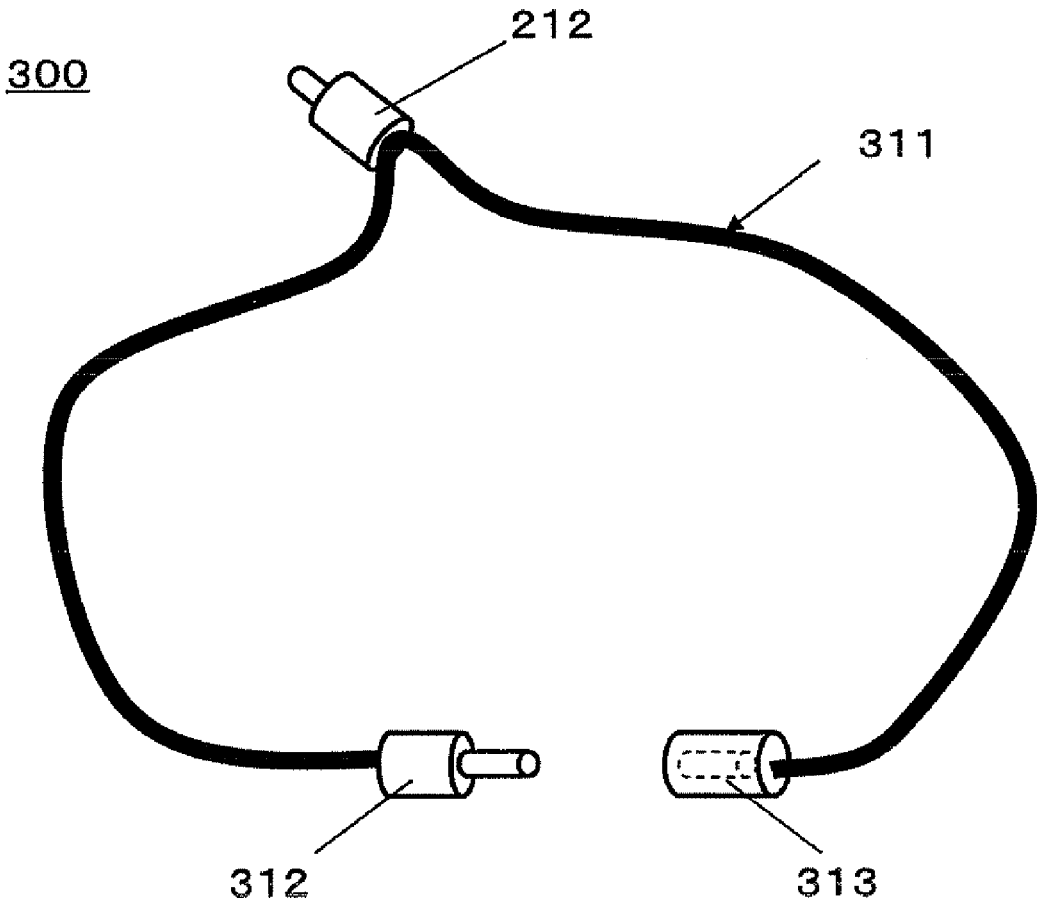
FIG. 5 is a diagram showing an antenna apparatus of the communication apparatus according to the first modification.

FIG. 4 is a diagram illustrating a first modification of the first embodiment. FIG. 5 is a diagram illustrating an antenna apparatus of the communication apparatus according to the present modified embodiment. It is noted that in FIGS. 4 and 5, components that are identical to those shown in FIGS. 1 and 2 are given the same numerical references, and their descriptions are omitted.

The antenna apparatus 300 according to the first modification includes an antenna device 311, and connectors 212, 311, and 312.

The antenna device 311 is modified by exposing the midsections of the antenna device 211 and attaching connectors 312 and 313 to the exposed ends. The connectors 312 and 313 may be a plug or socket connector such as an SMA connector, a BNC connector, or an earphone jack. As is shown in FIG. 5 in the present example, one of the connectors 312 or 313 corresponds to a socket connector and the other corresponds to a plug connector so that the connectors 312 and 313 may be attached/detached to/from each other.

FIGS. 6 through 11 illustrate exemplary applications of the antenna apparatus 300.

Figure 6:
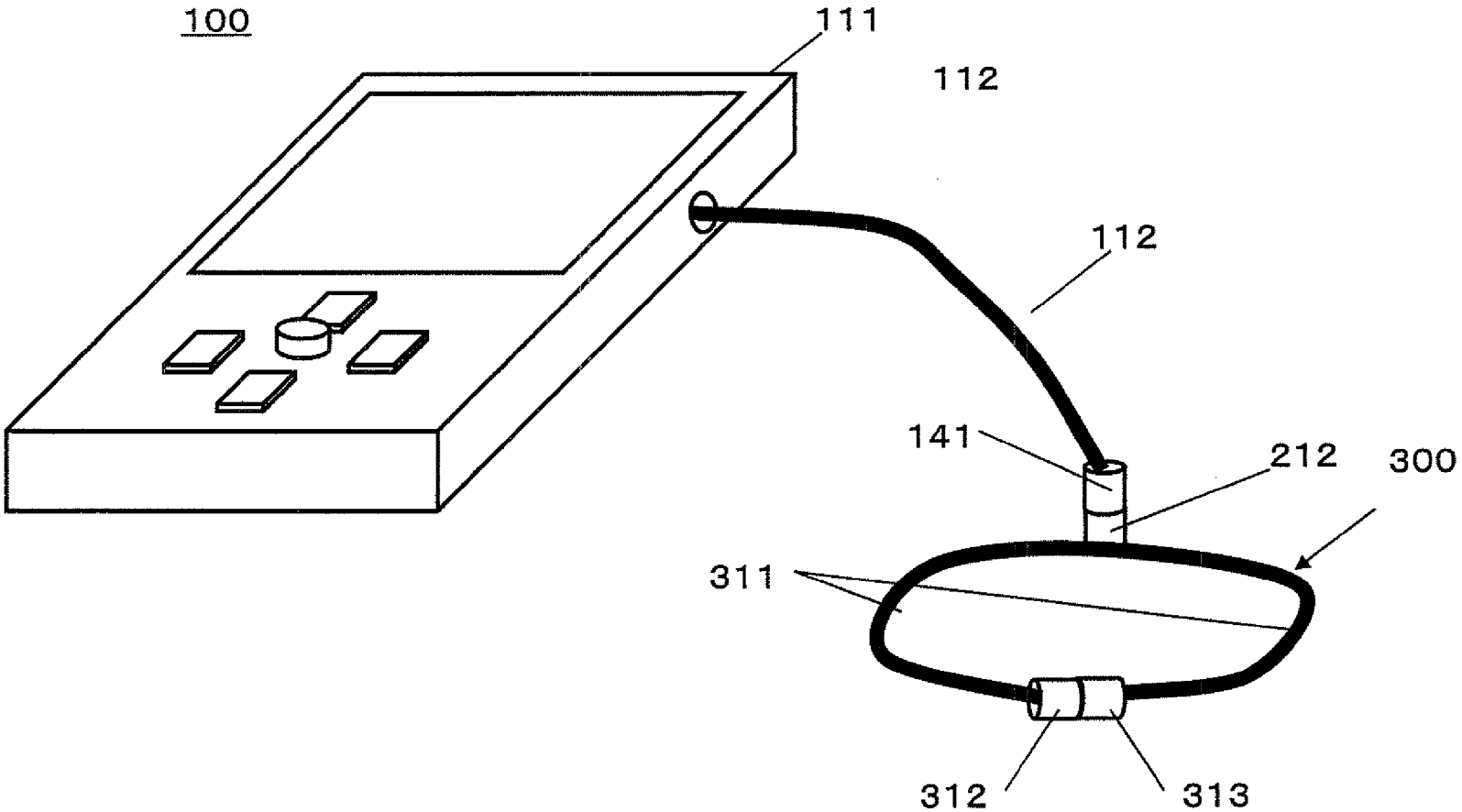
FIG. 6 is a diagram illustrating an exemplary application of the antenna apparatus according to the first modification.

In one example as is shown in FIG. 6, the connectors 312 and 313 of the antenna device 311 may be connected so that the antenna apparatus 300 may function as a loop antenna.

Figure 7:
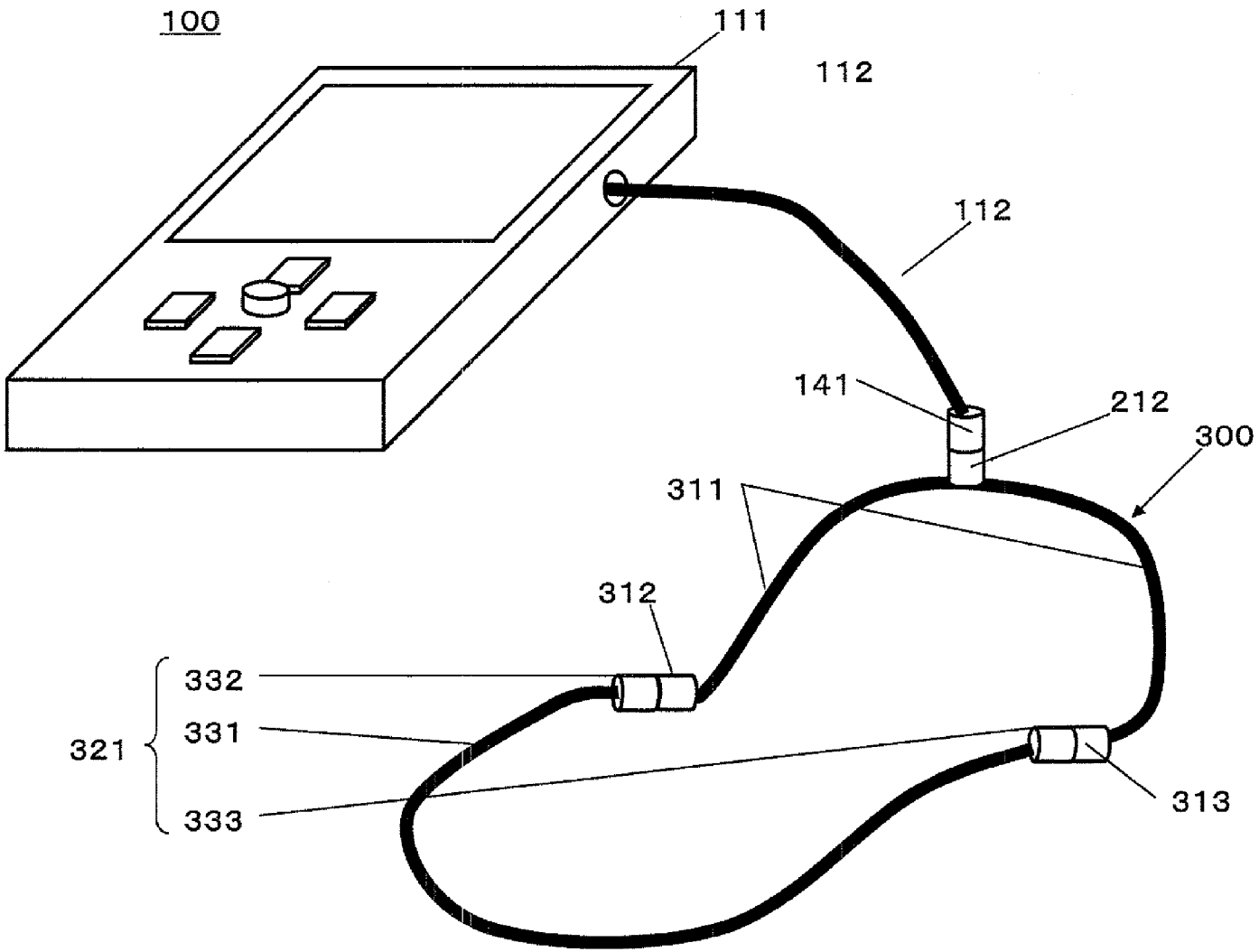
FIG. 7 is a diagram illustrating another exemplary application of the antenna apparatus according to the first modification.

In another example as is shown in FIG. 7, an extension antenna 321 having a length according to the communication frequency may be connected between the connectors 312 and 313 in order to optimize communication.

The extension antenna 321 includes an antenna device 331 and connectors 332 and 333, for example. The antenna device 331 is connected to the antenna device 311, to function as an antenna. The connectors 332 and 333 may be a plug or socket connector such as an SMA connector, a BNC connector, or an earphone jack. It is noted that of the connectors 332 or 333 corresponds to a socket connector and the other corresponds to a plug connector so that the connectors 332 and 333 may be attached/detached to/from each other.

Figure 8:
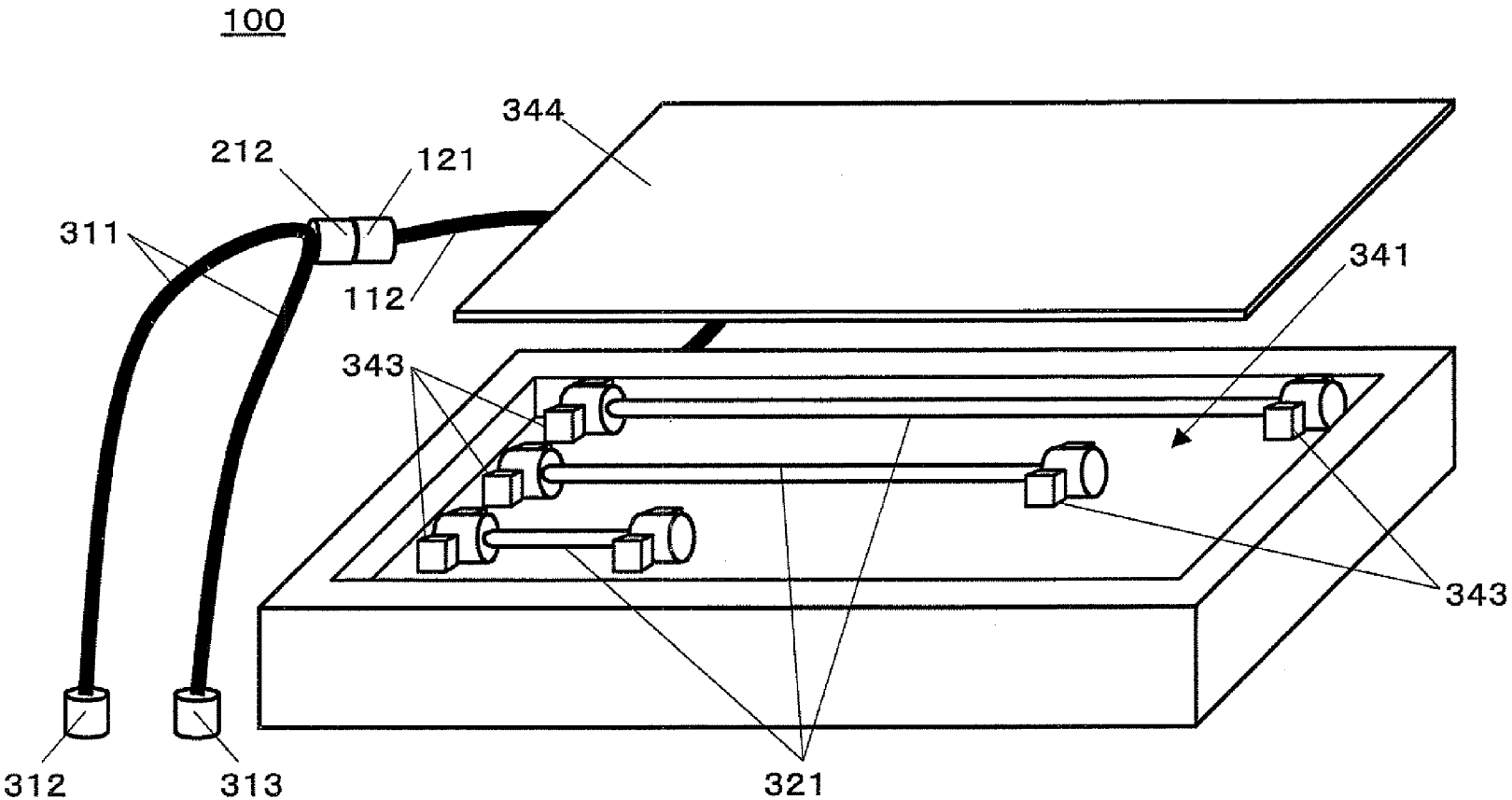
FIG. 8 is a diagram illustrating another exemplary application of the antenna apparatus according to the first modification.

In one preferred embodiment, an accommodation part 341 may be provided at the apparatus main frame 311 for accommodating plural extension antennas 321 with different lengths as is shown in FIG. 8. The accommodation part 341 may have protrusions 343 that engage the connectors 332 and 333 to detachably hold the extension antennas in place within the accommodation part 341. Also, a cover 344 is arranged to cover the opening of the accommodation part 341.

In this way, an extension antenna 321 with a suitable length according to the reception frequency may be taken out of the accommodation part 341 and attached to the antenna device 311 so that communication may be established under optimal conditions, for example.

Figure 9:
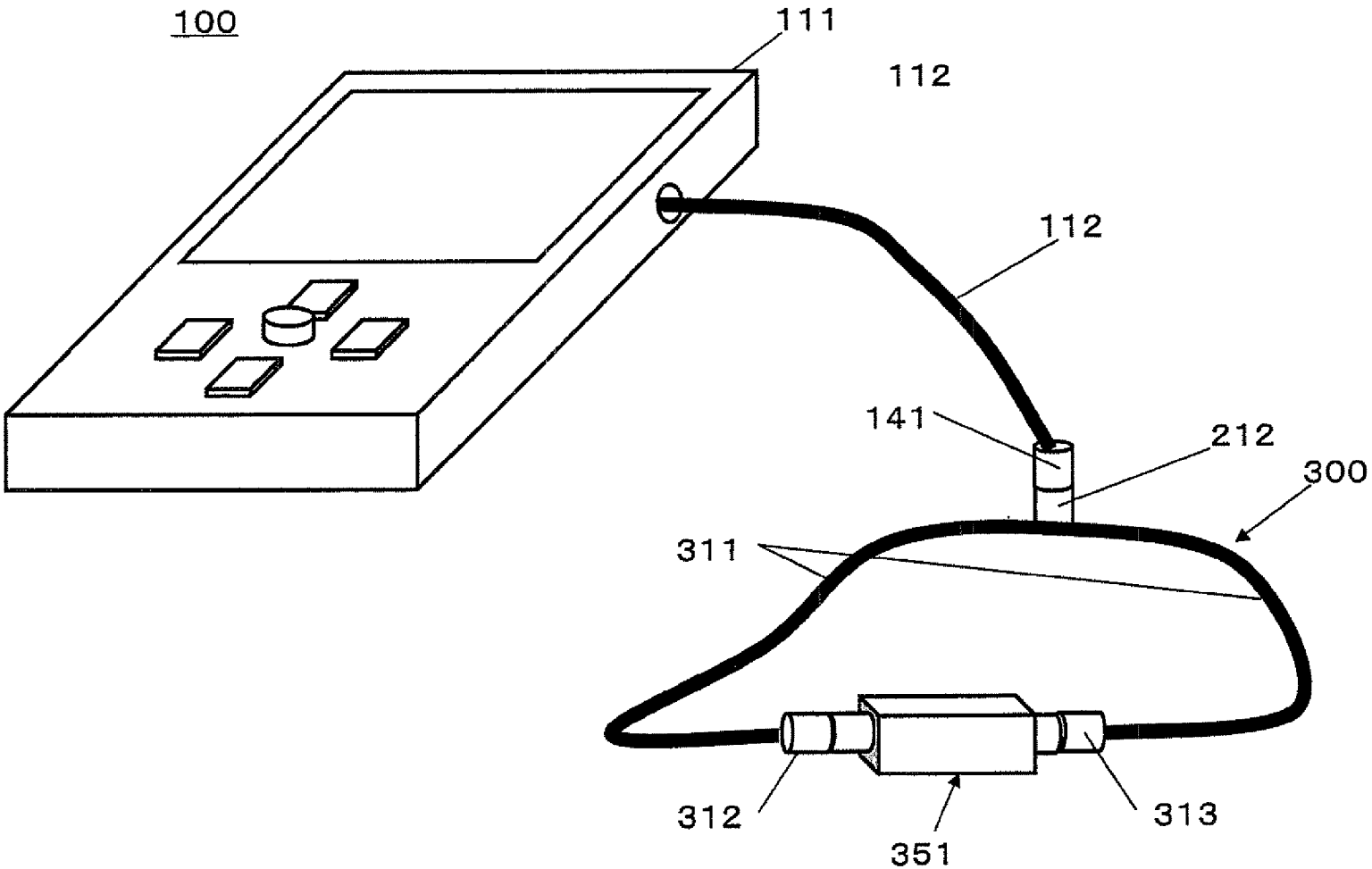
FIG. 9 is a diagram illustrating another exemplary application of the antenna apparatus according to the first modification.
Figure 10:
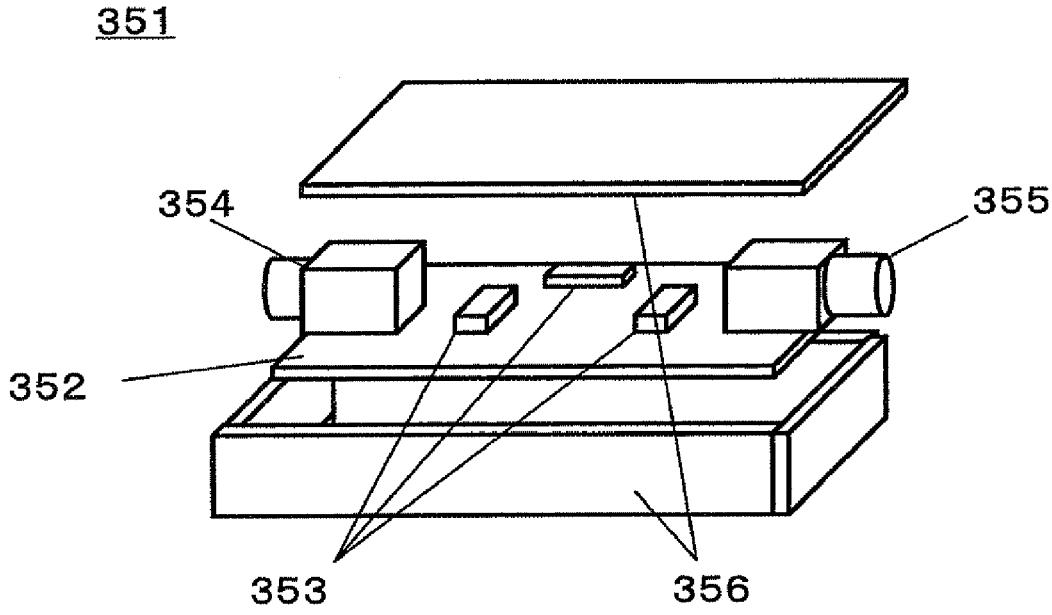
FIG. 10 is a diagram illustrating another exemplary application of the antenna apparatus according to the first modification.

In another example as is shown in FIG. 9, a matching circuit 351 may be connected between the connectors 312 and 313. As is shown in FIG. 10, the matching circuit 351 includes a case 356 that accommodates a circuit substrate 352 on which electronic components 353 such as a capacitor and an inductor, and connectors 354, 355 are mounted.

The connectors 354 and 355 may be a plug or socket connector such as an SMA connector, a BNC connector, or an earphone jack. It is noted that one of the connectors 354 or 355 corresponds to a socket connector and the other corresponds to a plug connector so that the connectors 332 and 333 may be attached/detached to/from each other.

The matching circuit 351 may be connected between the connectors 312 and 313 of the antenna device 311, between the antenna device 311 and the extension antenna 321, or between the antenna device 311 and the connection element 112, for example. In this way, the antenna device 311 may be appropriately matched.

It is noted that by interchanging the connection of the matching circuit 351 according to the usage environment, communication may be optimized, for example.

Figure 11:
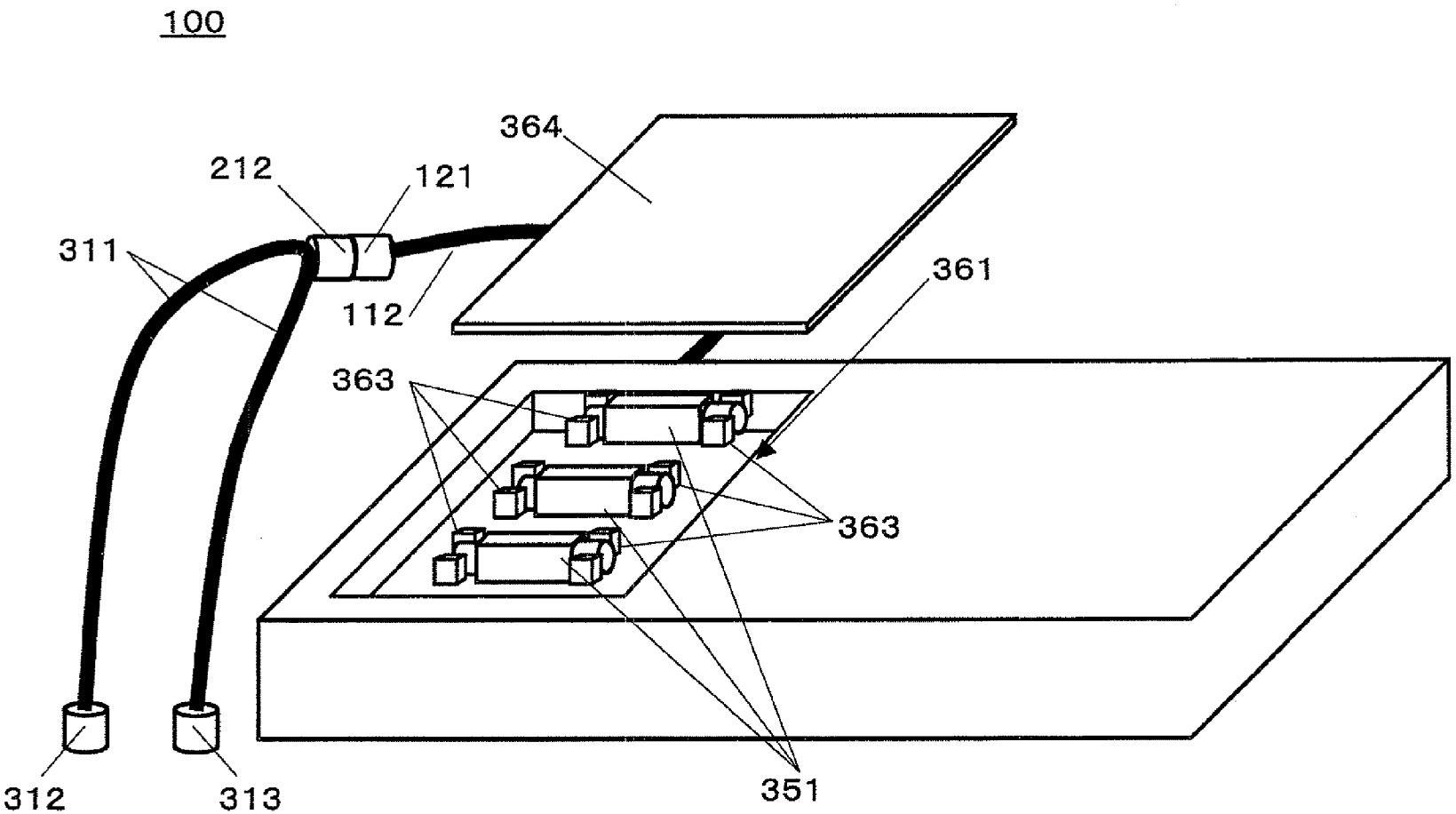
FIG. 11 is a diagram illustrating another exemplary application of the antenna apparatus according to the first modification.

In one preferred embodiment, as is shown in FIG. 11, an accommodation part 361 may be arranged at the apparatus main frame 111 for accommodating plural matching circuits 351 with differing characteristics. The accommodation part 361 has protrusions 363 for engaging the connectors 354 and 355 to detachably hold the matching circuits 351 in place within the accommodation part 361. Also, a cover 364 is arranged to cover the opening of the accommodation part 361.

In this way, the matching circuit 351 may be easily interchanged according to the reception frequency, for example, so that communication may be optimized.

In another preferred embodiment, the case 356 of the matching circuit 351 may be arranged into the shape of a stuffed animal, a doll, or an accessory, for example, to give design features to the matching circuit 351 and improve design appeal of the communication apparatus 100, for example.

[Second Modification]

Figure 12:
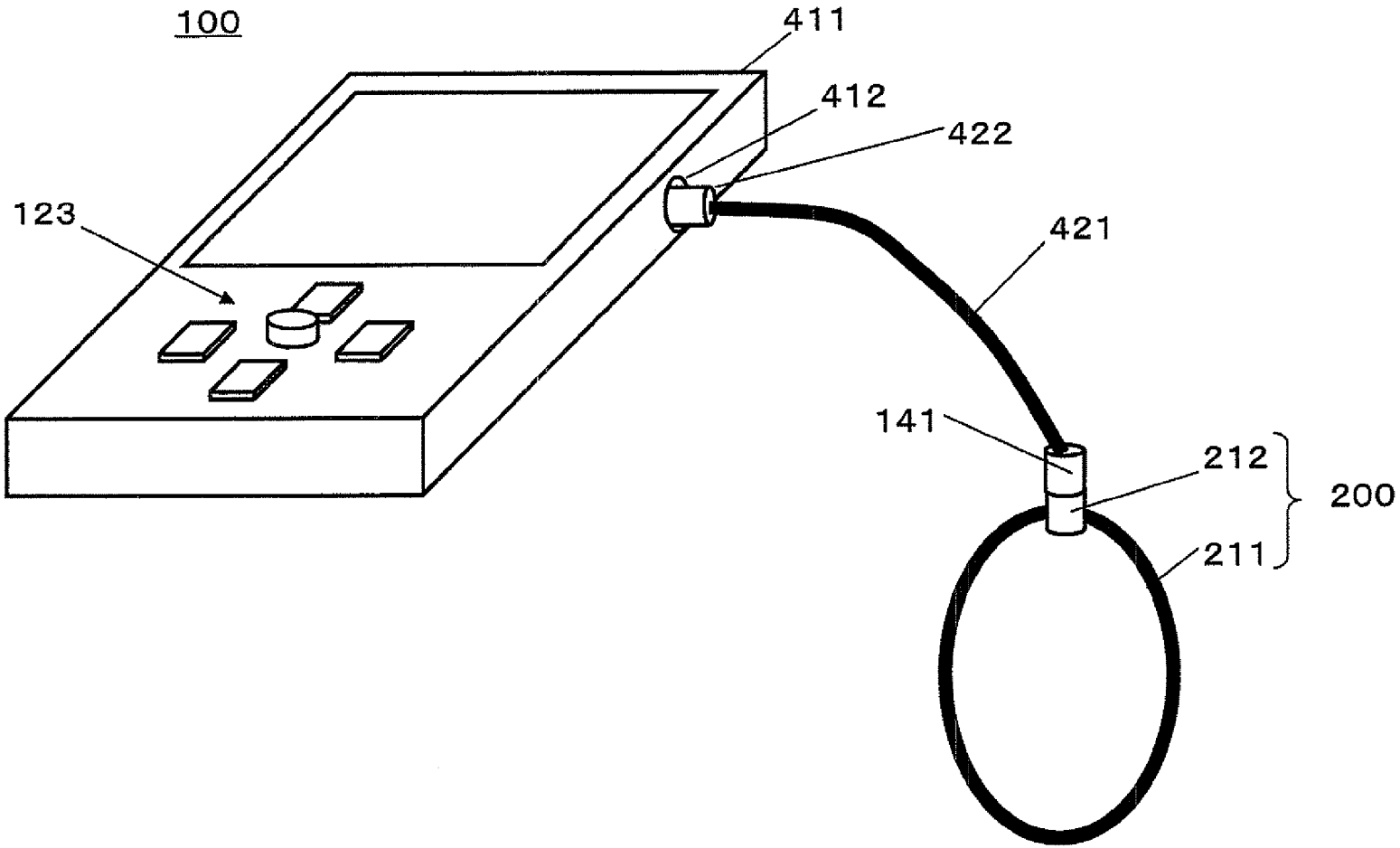
FIG. 12 is a perspective view of a communication apparatus according to a second modification of the first embodiment.
Figure 13:
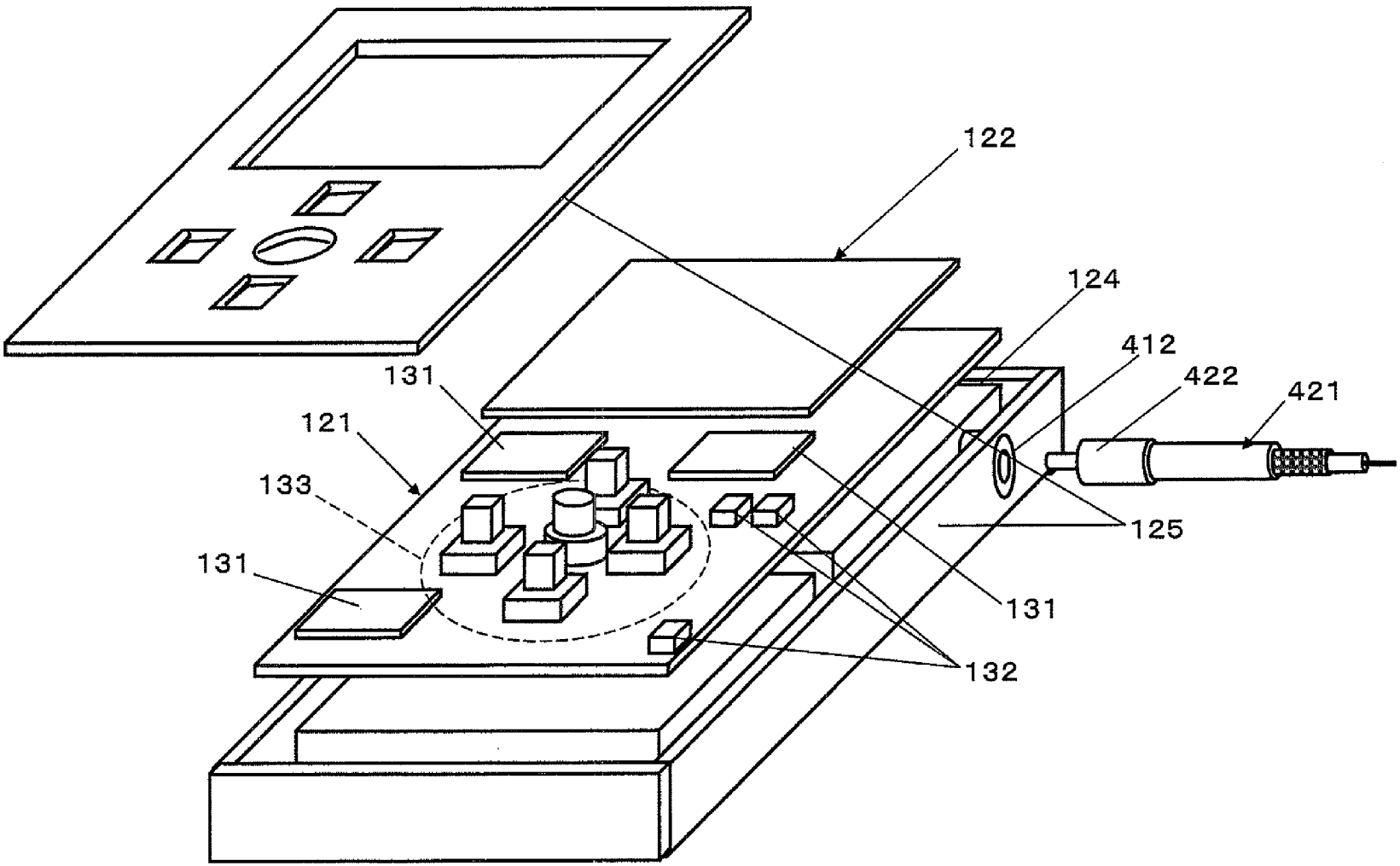
FIG. 13 is an exploded perspective view of an apparatus main frame of the communication apparatus according to the second modification.

FIG. 12 is a perspective view of a communication apparatus according to a second modification of the first embodiment. FIG. 13 is an exploded perspective view of a main apparatus frame of the communication apparatus according to the present modified embodiment. It is noted that in FIGS. 12 and 13, components that are identical to those shown FIGS. 1 and 2 are given the same reference numerals and their descriptions are omitted.

The portable communication apparatus 100 according to the present modified embodiment may be a PDA, a mobile phone, a portable TV, a portable radio, or a portable personal computer, for example, that includes an apparatus main frame 411, an antenna apparatus 200, and a connector 412 that is exposed at the side of the apparatus main frame 411 for connecting the apparatus main frame 411 to the antenna apparatus 200.

The connector 412 may be a plug or socket connector such as an SMA connector, a BNC connector, or an earphone jack that is fixed to a circuit substrate within the communications unit 124 of the communication apparatus 100 through soldering, for example.

A connecting element 421 according to the present modified embodiment has one end integrally attached to a connector 422. The connector 422 may be a plug or socket connector such as an SMA connector, a BNC connector, or an earphone jack that may be detachably connected to the connector 412 that is exposed at the side of the apparatus main frame 411.

According to the present modified embodiment, the connecting element 421 may be detached from the apparatus main frame 411 of the portable communication apparatus 100.

[Third Modification]

Figure 14:
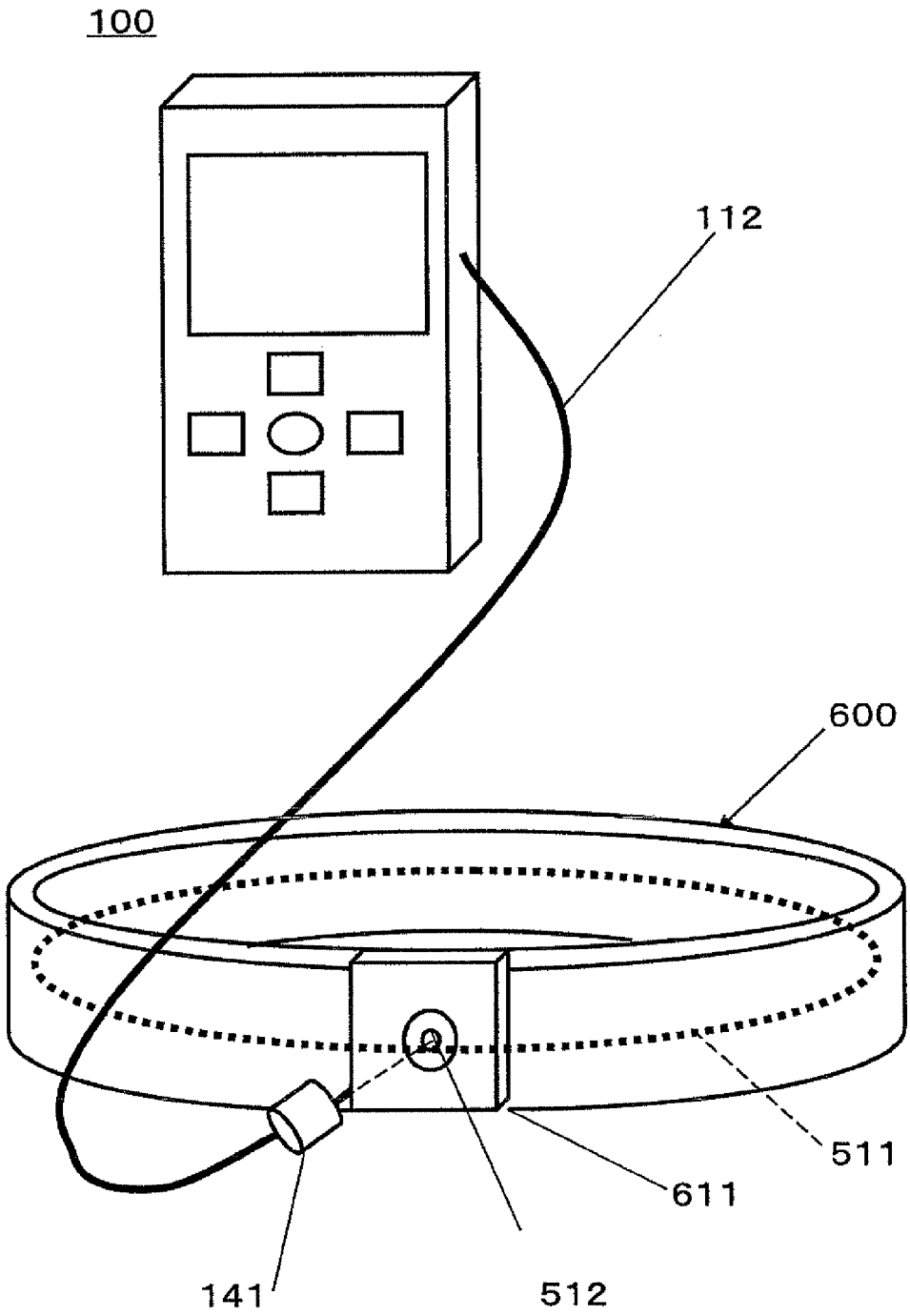
FIG. 14 is a perspective view of a communication apparatus according to a third modification of the first embodiment.

FIG. 14 is a perspective view of a communication apparatus according to a third modification of the first embodiment. In this drawing, components that are identical to those shown in FIG. 1 are given the same numerical references, and their descriptions are omitted.

The antenna apparatus 500 according to the present modified embodiment has an antenna device 511 built inside a belt 600, and a connector 512 arranged at a buckle 611 of the belt 600 for connecting the connecting element 112 to the antenna device 511. It is noted that the connector 512 does not necessarily have to be arranged at the buckle 611, and may instead be arranged at some other suitable position on the belt 600, for example.

[Fourth Modification]

Figure 15:
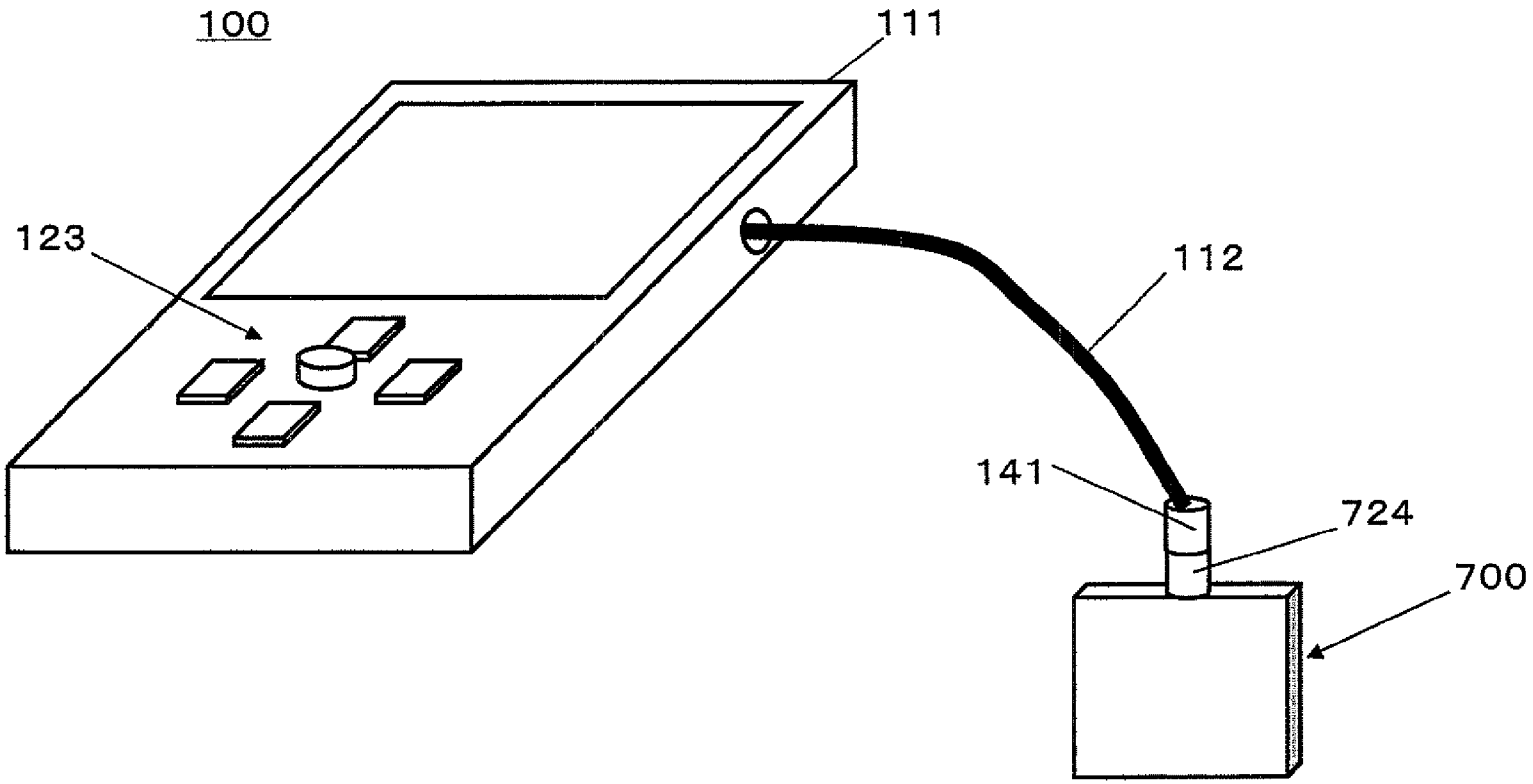
FIG. 15 is a perspective view of a communication apparatus according to a fourth modification of the first embodiment.

FIG. 15 is a perspective view of a communication apparatus according to a fourth modification of the first embodiment. In this drawing, components that are identical to those shown in FIG. 1 are given the same numerical references, and their descriptions are omitted.

The communication apparatus according to the present modification, includes an antenna apparatus 700 that corresponds to a UWB antenna.

Figure 16:
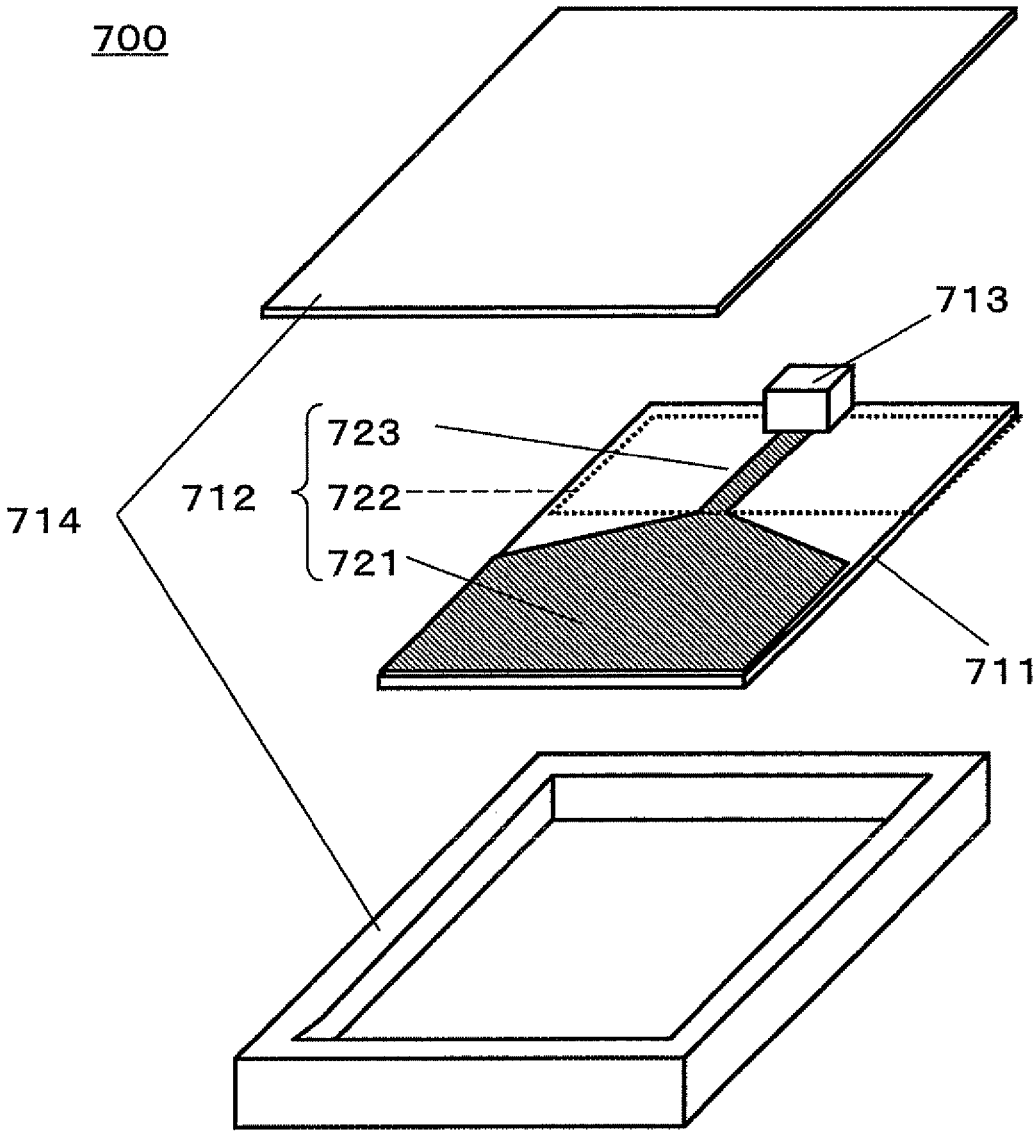
FIG. 16 is an exploded perspective view of an antenna apparatus of the communication apparatus according to the fourth modification.

FIG. 16 is an exploded perspective view of the antenna apparatus 700.

As is shown in this drawing, the antenna apparatus 700 includes a case 714 that accommodates a dielectric substrate 711 with a conductive pattern 712 formed thereon and a connector 713. The conductive pattern 712 includes an element pattern 721, a ground pattern 722, a strip line 723, and a connector 724.

The element pattern 721 is formed on the surface of the dielectric substrate 711 to cover substantially half of the dielectric substrate 711. The ground pattern 722 is formed on the rear face of the dielectric substrate 711 to cover the other half of the dielectric substrate 711 so that an edge of the ground pattern opposes an edge of the element pattern formed on the other side of the dielectric substrate 711. The edge of the element pattern 721 opposing the edge of the ground pattern 722 may be shaped like the side edges of a fan to form a predetermined angle with the opposing edge of the ground pattern 722. It is noted, however, that the element pattern 711 is not limited to such a configuration as long as it is capable of establishing UWB communication.

The strip line 723 is formed on the surface of the dielectric substrate 711 and extends from the tip of the fan-shaped edge of the element pattern 721 across the half portion of the dielectric substrate 711 having the ground pattern 722 formed on the other side. The strip line 723 is used to supply power to the element pattern 721.

The connector 713 is fixed to the dielectric substrate 711 by being soldered to the ground pattern 722 and the extending end of the strip line 723.

According to the present modification, the antenna apparatus 700 may be positioned away from the apparatus main frame 111 by means of the connecting element 112 so that the UWB communication may be established without receiving influences from the apparatus main frame 111.

It is noted that in one preferred embodiment, the case 714 may be arranged into the shape of a stuffed animal, a doll, or an accessory for example, to give design features to the antenna apparatus 700 and improve design appeal of the portable communication apparatus 100.

[Fifth Modification]

Figures 17A, 17B:
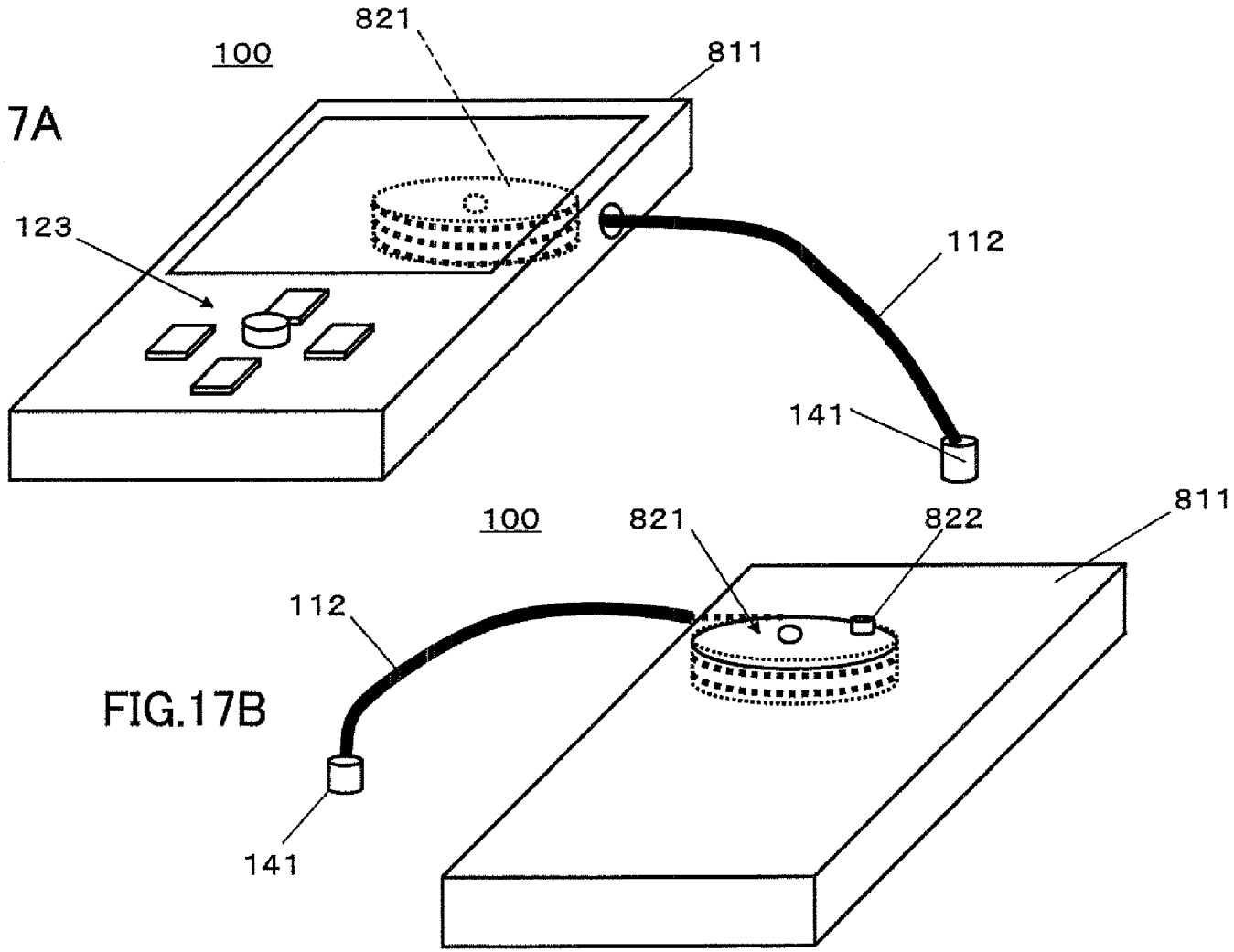
FIGS. 17A and 17B are diagrams illustrating a communication apparatus according to a fifth modification of the first embodiment.

FIGS. 17A and 17B are perspective views of a communication apparatus according to a fifth modification of the first embodiment. In this drawing, components that are identical to those shown in FIGS. 1 and 2 are given the same numerical references and their descriptions are omitted.

According to the present modified embodiment, an apparatus main frame 811 includes a winding mechanism 812 for winding and accommodating the connecting element 112.

In one example, the winding mechanism 812 may include a winding part 821 and a winding lever 822 for winding the connecting element 112 within the apparatus main frame 811. In this way, when communication is not being established, the connecting element 112 may be wound around the winding mechanism 812 to be accommodated within the apparatus main frame 811.

Second Embodiment

Figure 18:
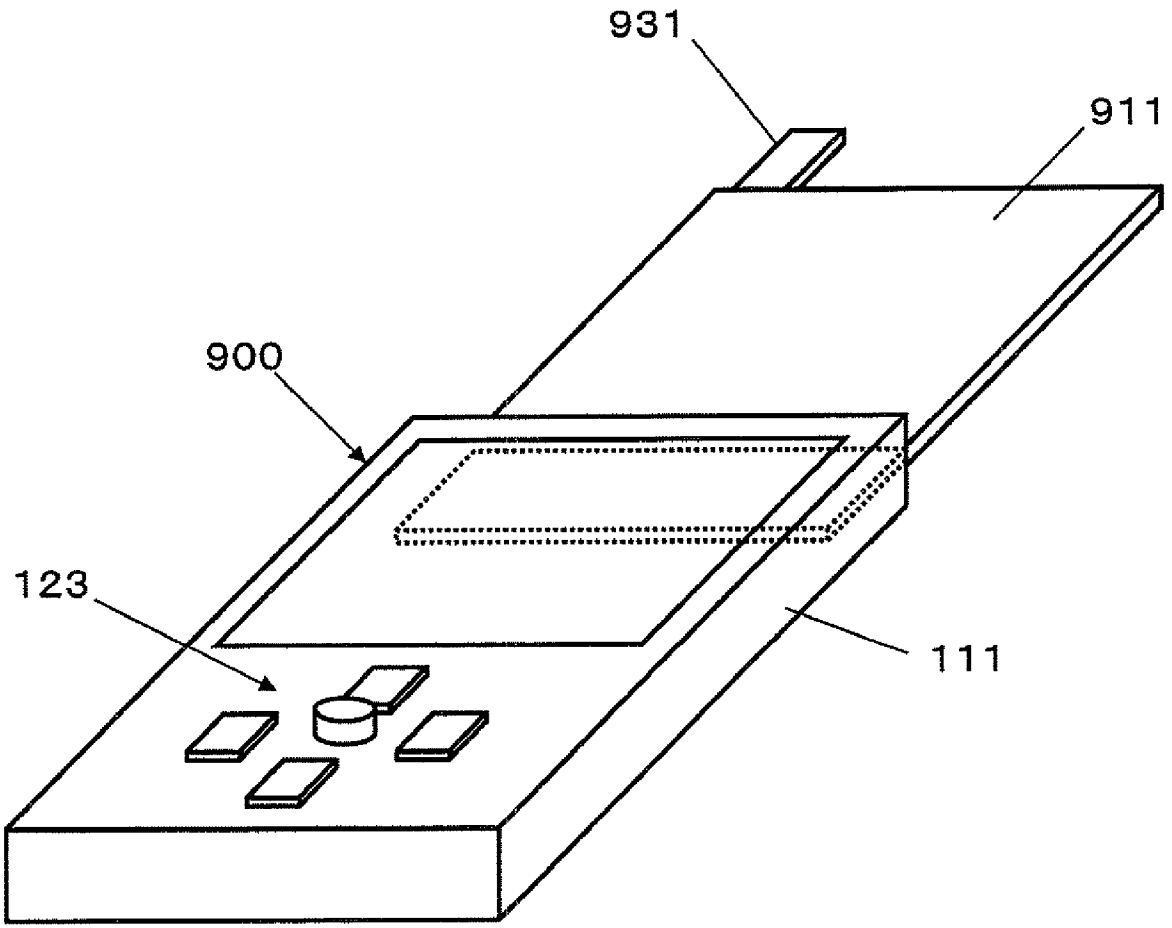
FIG. 18 is a perspective view of a communication apparatus according to a second embodiment of the present invention.
Figure 19A:
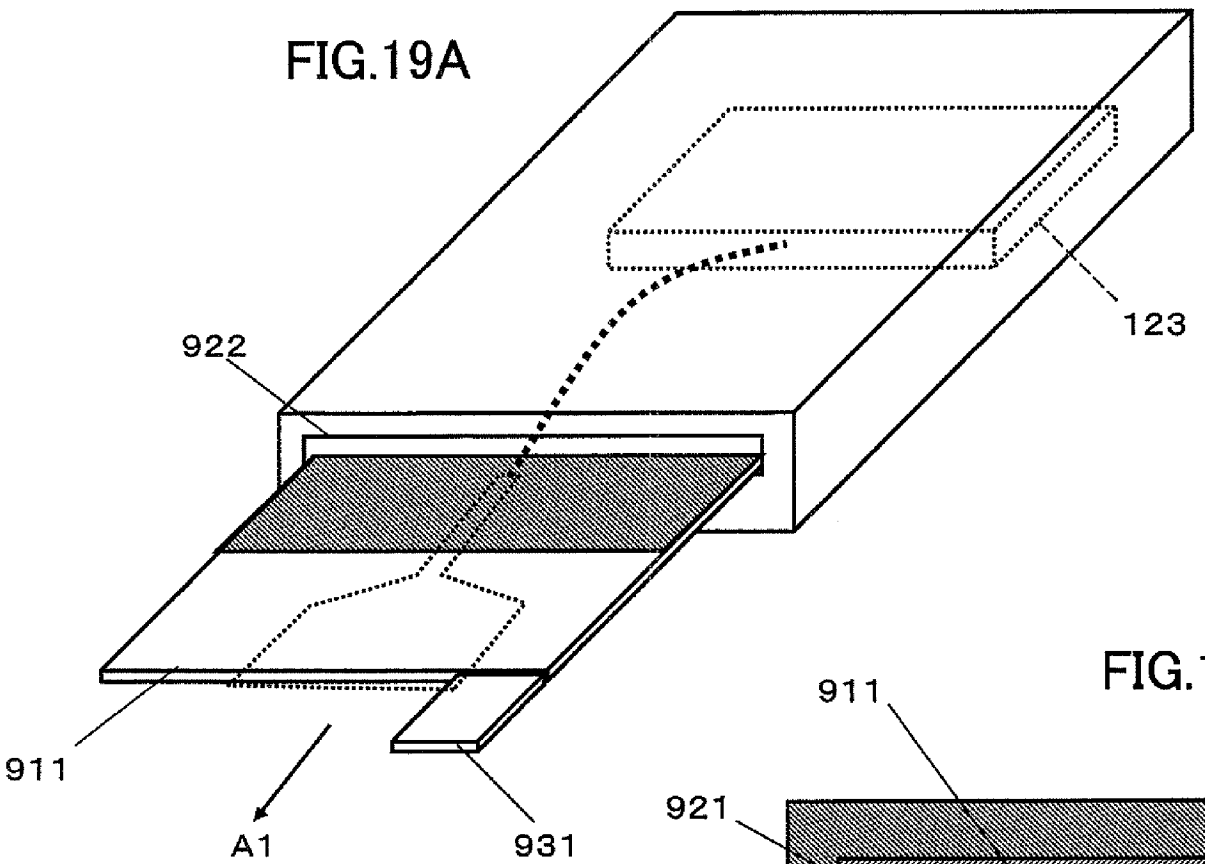
Figure 19B:
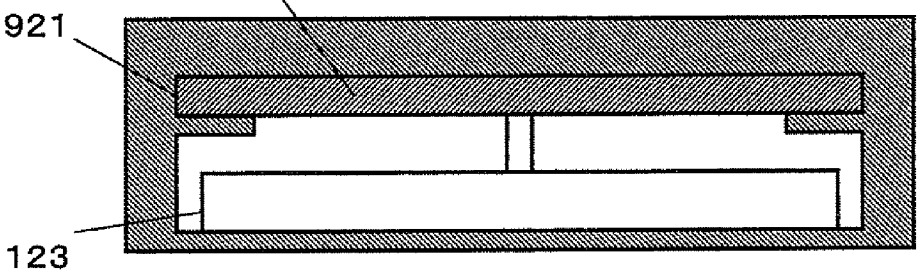

FIG. 18 is a perspective view of a communication apparatus according to a second embodiment of the present invention. FIGS. 19A and 19B are diagrams illustrating an apparatus main frame of the communication apparatus according to the present embodiment. It is noted that in these drawings, components that are identical to those shown in FIGS. 1 and 2 are given the same numerical references and their descriptions are omitted.

The portable communication apparatus 900 of the present embodiment has an antenna apparatus 911 that is built inside an apparatus main frame 111. It is noted that the configuration of the antenna apparatus 911 may be substantially identical to the antenna apparatus 700 shown in FIG. 16. According to the present embodiment, the antenna apparatus 911 may be extended out of the apparatus main frame 111 by means of a slide mechanism.

The slide mechanism comprises a guide groove 921 and an opening 922. The guide groove 921 slidably engages the side edges of the antenna apparatus 911 and guides the antenna apparatus 911 in the direction indicated by arrow A1 shown in FIG. 19A. In this case, the antenna apparatus 911 and the guide groove 921 have a predetermined friction power. Owning to such friction power, the antenna apparatus 911 may be stopped at a desired sliding position. The antenna apparatus 911 has a pullout member 931 arranged at its tip portion. The pullout member 931 protrudes outward from the opening 922 even when the antenna apparatus 911 is accommodated inside the apparatus main frame 111.

A user may grip the pullout member 931 protruding from the case of the apparatus main frame 911, and pull the pullout member in the direction indicated by the arrow A1 shown in FIG. 19A so that the antenna apparatus 911 may be pulled out of the case.

[First Modification]

Figure 20A:
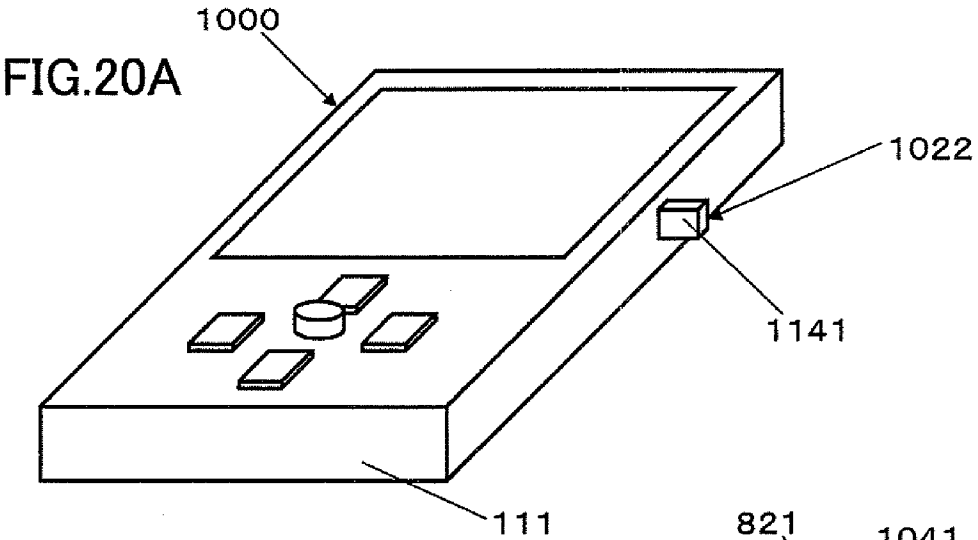
FIGS. 20A and 20B are diagrams illustrating a communication apparatus according to a first modification of the second embodiment.
Figure 20B:
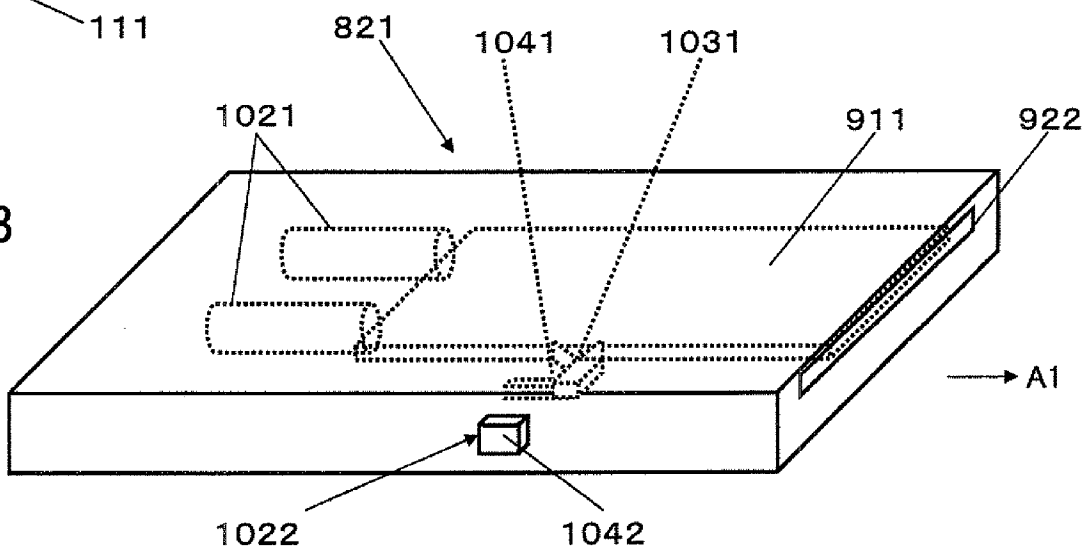

FIGS. 20A and 20B are perspective views of a communication apparatus according to a first modification of the second embodiment. In this drawing, components that are identical to those shown in FIGS. 18, 19A, and 19B are given the same numeric references and their descriptions are omitted.

The portable communication apparatus 1000 according to the present modified embodiment includes an apparatus main frame 111 having springs 1021 and a stop mechanism 1022.

The springs 1021 are arranged within a case 821 of the apparatus main frame 111 and push the antenna apparatus 911 in the direction indicated by arrow Al shown in FIG. 19B. The stop mechanism 1022 includes a protrusion 1031 that is arranged at the side of the antenna apparatus 911, an engaging member 1041 arranged at the apparatus main frame 111 that engages the protrusion 1031 and holds the antenna 911 within the case 812 against the force of the springs 1021, and a button 1042 for releasing the engagement between the protrusion 1031 and the engaging member 1041.

The user may manipulate the button 1042 to disengage the protrusion 1031 and the engaging member 1041 so that the antenna apparatus 911 may be thrust forward in the direction indicated by the arrow A1 by the force of the springs 921 to extend outward from the opening 922.

According to the present modified embodiment, the antenna apparatus 911 may be automatically extended by manipulating the button 1042.

[Second Modification]

Figure 21A:
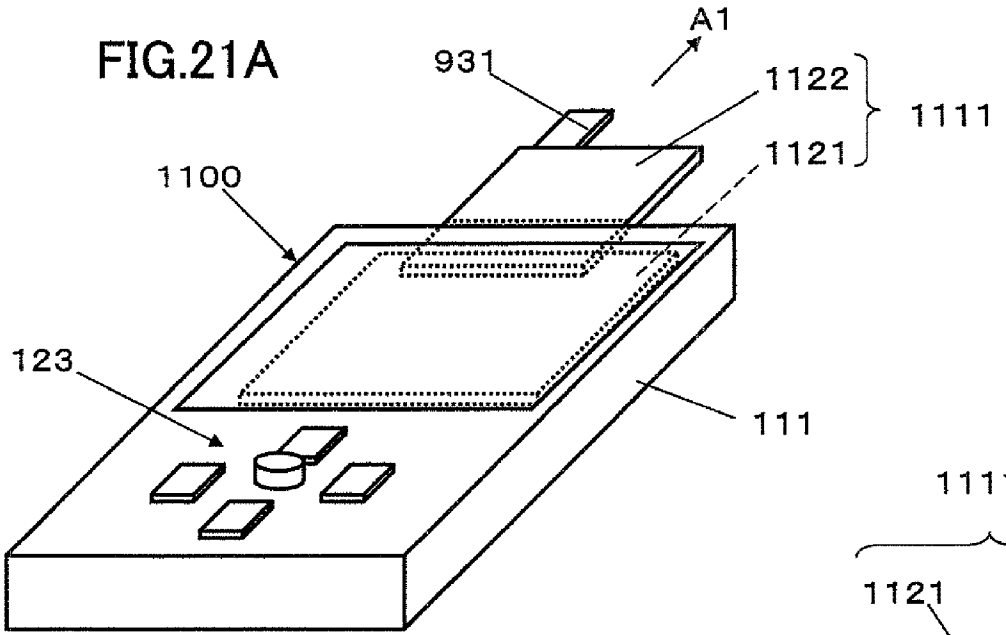
FIGS. 21A and 21B are diagrams illustrating a communication apparatus according to a second modification of the second embodiment.
Figure 21B:
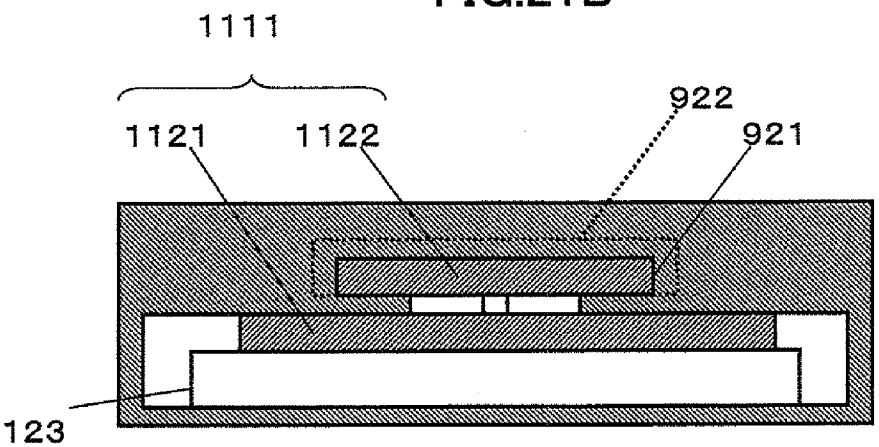

FIGS. 21A and 21B are diagrams showing a communication apparatus according to a second modification of the second embodiment. It is noted that in these drawings, components that are identical to those shown in FIGS. 20A and 20B are given the same numerical references and their descriptions are omitted.

The portable communication apparatus 1100 according to the present modified embodiment has an antenna apparatus 1111 including a ground part 1121 and an element part 1122. When the antenna apparatus 1111 is accommodated within the apparatus main frame 111, the element part 1122 is arranged on top of the ground part 1121. When the antenna apparatus 1111 is extended, the element part 1122 is slid in the direction indicated by arrow A1 shown in FIG. 21B to extend further outward from the ground part 1121.

According to the present modified embodiment, when the antenna apparatus 1111 is accommodated within the apparatus main frame 111, the element part 1122 is arranged on top of the ground part 1121 so that the antenna apparatus 1111 takes up less space. Also, since the element part 1122 has a smaller area than the ground part 1121, the size of a portion protruding from the apparatus main frame 111 may be reduced by having only the element part 1122 extend outward from the apparatus main frame 111.

Third Embodiment

Figure 22A:
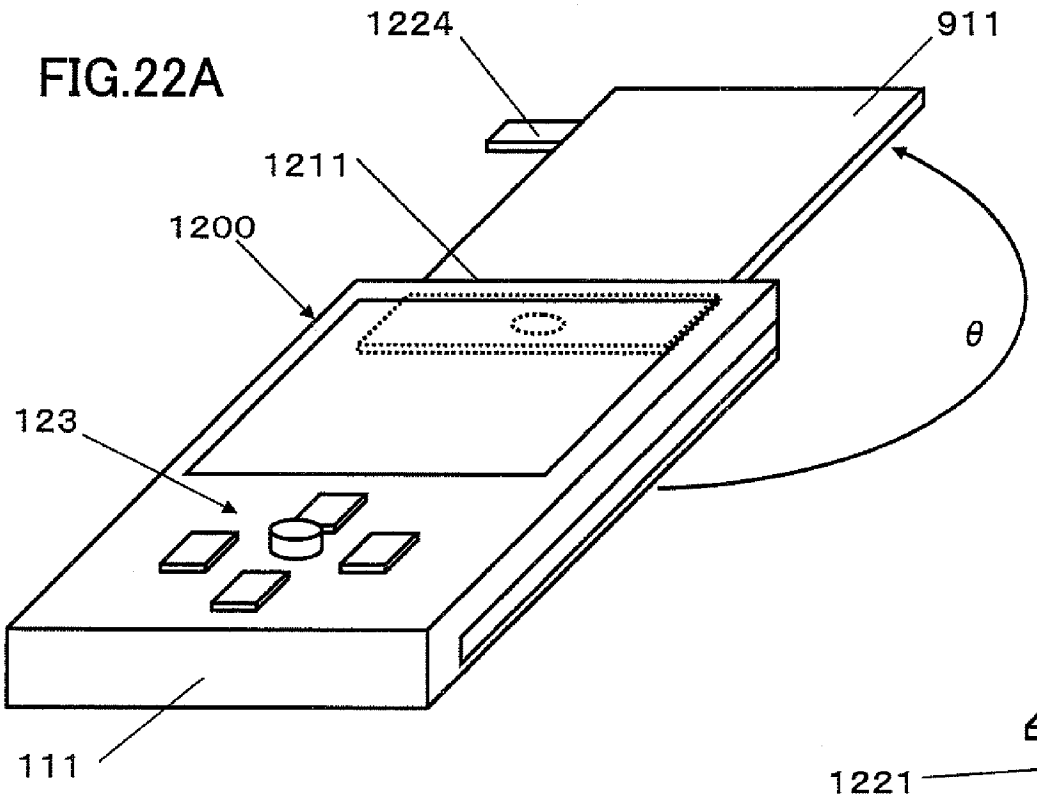
FIGS. 22A and 22B are diagrams illustrating a communication apparatus according to a third embodiment of the present invention.
Figure 22B:
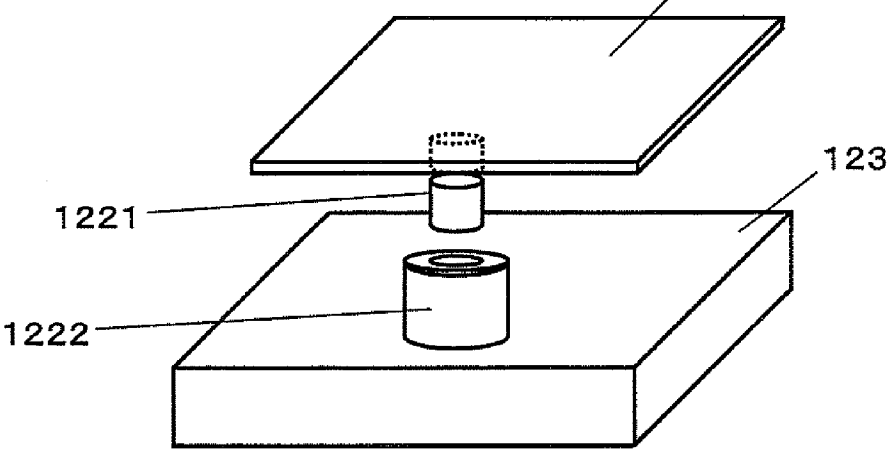

FIGS. 22A and 22B are diagrams illustrating a third embodiment of the present invention. It is noted that in these drawings, components that are identical to those shown in FIGS. 17A and 17B are given the same numerical references and their descriptions are omitted.

The portable communication apparatus 1200 according to the present embodiment has an antenna apparatus 911 built inside its apparatus main frame 111 as with the portable communication apparatus 900 according to the second embodiment. In this embodiment, the antenna apparatus 911 is mounted on a rotating mechanism 1211 and is rotated by the rotating mechanism 1211 to be extended out of the apparatus main frame 111.

The rotating mechanism 1211 comprises a pin 1221 that is attached to the antenna apparatus 911 and a receptacle 1222 that is arranged at the communications unit 123. The pin 1221 is rotatably inserted into the receptacle 1222. It is noted that the pin 1221 and the receptacle 1222 are positioned at the upper part of the apparatus main frame 111.

In the present embodiment, the apparatus main frame 111 has an opening 1123 formed across its top and lateral side faces from which opening 1123 the antenna apparatus 911 may be pulled out of the apparatus main frame 111. Also, a pullout member 1224 that protrudes from the opening 1123 when the antenna apparatus 911 is accommodated within the apparatus main frame 111 is arranged at a side edge portion of the antenna 911.

When the user pulls the pullout member 1224 in the direction indicated by arrow θshown in FIG. 22A, the antenna apparatus 911 is rotated around the pin 1221 in the direction of the arrow θ to be pulled out of the apparatus main frame 111.

[Modification]

Figure 23A:
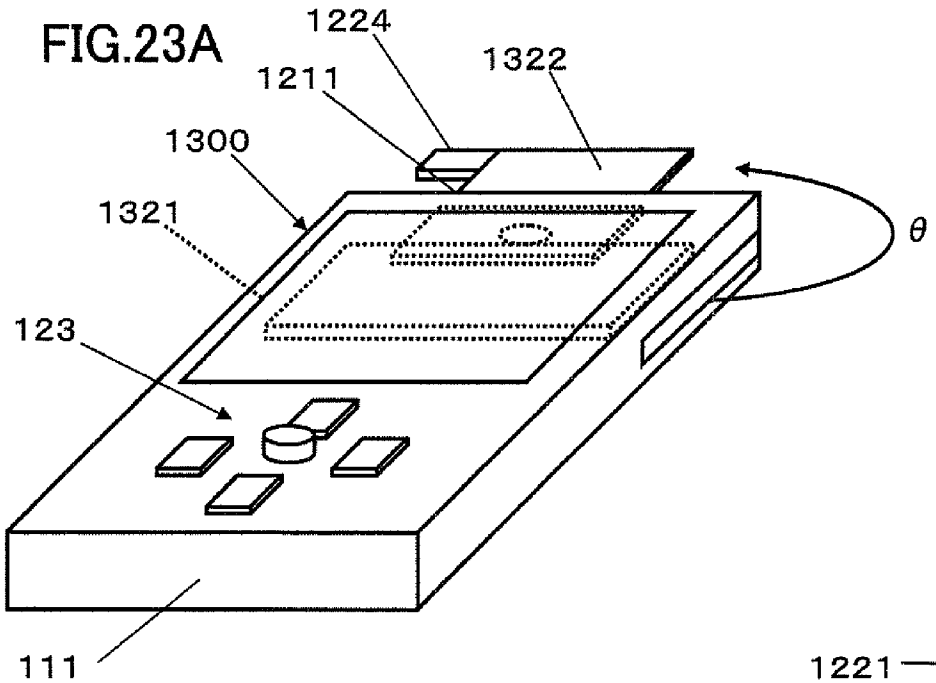
FIGS. 23A and 23B are diagrams illustrating a communication apparatus according to a modification of the third embodiment.
Figure 23B:
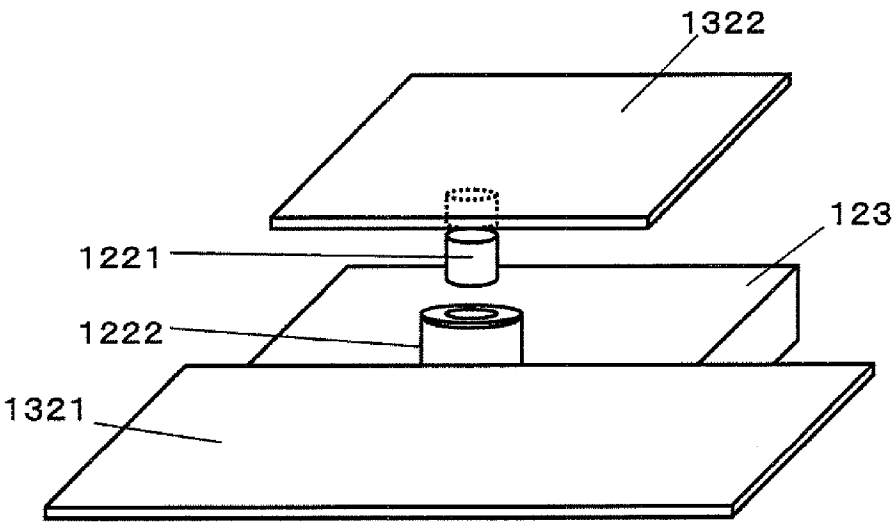

FIGS. 23A and 23B are diagrams illustrating a modification of the third embodiment. It is noted that in these drawings, components that are identical to those shown in FIGS. 22A and 22B are given the same numerical references and their descriptions are omitted.

The portable communication apparatus 1300 according to the present modified embodiment has an antenna apparatus 1311 comprising a ground part 1321 and an element part 1322 where the element part 1322 is arranged to freely rotate by means of a pin 1221 and a receptacle 1222. When the antenna apparatus 1311 is accommodated within the apparatus main frame 111, the element part 1322 is arranged on top of the ground part 1321, and when the antenna apparatus 1311 is extended out of the apparatus main frame 111, the element part 1322 is rotated in the direction indicated by arrow θ shown in FIG. 23A.

According to the present modified embodiment, the element part 1322 is arranged on top of the ground part 1321 when the antenna apparatus 1311 is accommodated within the apparatus main frame 111 so that the antenna apparatus 1311 may take up less space within the apparatus main frame 111, for example.

In one example, the portable communication according to an embodiment of the present invention may be a dongle that includes a communications module that is connected to a USB port or a IEEE 1394 port.

Further, the present invention is not limited to the above-described embodiments, and variations and modifications may be made without departing from the scope of the present invention.

The present application is based on and claims the benefit of the earlier filing date of Japanese Patent Application No. 2006-010236 filed on Jan. 18, 2006, the entire contents of which are hereby incorporated by reference.

What is claimed is:

1. A communication apparatus, comprising:

an apparatus main frame; and an antenna configured to be accommodated within the apparatus main frame, the antenna including a tab that protrudes to an outside of the apparatus main frame even when the antenna is fully accommodated within the apparatus main frame, the tab being configured to slide the antenna out of the apparatus main frame and position the antenna away from the apparatus main frame, the antenna being configured to be accommodated within a groove of the apparatus main frame and the antenna and the groove having a predetermined friction force therebetween such that the antenna can be stopped at any desired sliding position with respect to the apparatus main frame.

2. The communication apparatus as claimed in claim 1, wherein the tab is configured to slide the antenna out of the groove and position the antenna away from the apparatus main frame.

* * * * *